US005595277A

United States Patent [19]

Hoormann et al.

[11] Patent Number: 5,595,277

[45] Date of Patent: Jan. 21, 1997

[54] COIN PAYOUT METHOD AND CONTROL MEANS

[75] Inventors: Ronald A. Hoormann, St. Charles; Douglas M. Petty, Clayton, both of Mo.

[73] Assignee: Coin Acceptors, Inc., St. Louis, Mo.

[21] Appl. No.: 327,272

[22] Filed: Oct. 21, 1994

[51] Int. Cl.[6] ..... G07D 1/06

[52] U.S. Cl. ..... 194/217

[58] Field of Search ..... 194/216, 217, 194/218; 453/17

[56] References Cited

U.S. PATENT DOCUMENTS

| | | | |
|---|---|---|---|
| 3,754,629 | 8/1973 | Douglass | 194/201 X |
| 3,820,642 | 6/1974 | Levasseur | 194/217 X |
| 3,841,456 | 10/1974 | Levasseur | 194/217 X |
| 3,963,035 | 6/1976 | Levasseur | 194/216 X |
| 4,188,961 | 2/1980 | Heiman | 194/216 X |
| 4,192,972 | 3/1980 | Bertoglio et al. | 179/6.3 |
| 4,376,478 | 3/1983 | Sugimoto et al. | 194/218 |
| 4,462,512 | 7/1984 | Schuller | 194/217 |
| 4,491,140 | 1/1985 | Eglise et al. | 194/217 X |
| 4,499,982 | 2/1985 | Sugimoto et al. | 194/217 |
| 4,512,454 | 4/1985 | Schuller et al. | 194/346 |
| 4,587,984 | 5/1986 | Levasseur et al. | 453/17 |
| 4,706,202 | 11/1987 | Kobayashi et al. | 364/479 |
| 4,763,769 | 8/1988 | Levasseur | 194/217 |
| 4,883,158 | 11/1989 | Kobayashi et al. | 194/217 |
| 5,092,816 | 3/1992 | Levasseur | 453/17 |
| 5,184,708 | 2/1993 | Levasseur | 194/217 |

FOREIGN PATENT DOCUMENTS

| | | | |
|---|---|---|---|
| 2269258 | 2/1994 | United Kingdom | 453/20 |
| 9403875 | 2/1994 | WIPO . | |

*Primary Examiner*—F. J. Bartuska

*Attorney, Agent, or Firm*—Haverstock, Garrett & Roberts

[57] ABSTRACT

A device and method for controlling change payout from a plurality of coin tubes of a vending machine, each of which plurality of coin tubes has a particular coin type stored therein, including a processor for processing data and controlling vend operations and counters for maintaining a count of the coins in each of the plurality of coin tubes, the processor programmed to determine the amount of change payback and whether a particular coin type available for payout is desired to be saved and the identity of such coin type, and further programmed to generate a payout array in which the number of coins of the coin type desired to be saved has been reduced from the number that would otherwise be specified and the number of coins of other coin types are adjusted accordingly.

6 Claims, 6 Drawing Sheets

| PAYOUT AMOUNT | COIN TYPE | | | | COINS AVAIL_ | | | | COIN_ TO _SAVE | | | | LEAST COIN PAYOUT ARRAY | | | | SAVE COIN PAYOUT ARRAY | | | |
|---|---|---|---|---|---|---|---|---|---|---|---|---|---|---|---|---|---|---|---|---|
| | D | Q | D | N | D | Q | D | N | D | Q | D | N | D | Q | D | N | D | Q | D | N |
| 1. 70¢ | – | X | X | X | – | F | F | F | – | X | – | – | – | 2 | 2 | 0 | – | 1 | 4 | 1 |
| 2. 70¢ | – | X | X | X | – | 10 | 3 | F | – | X | – | – | – | 2 | 2 | 0 | – | 1 | 3 | 3 |
| 3. 70¢ | – | X | X | X | – | 10 | 0 | F | – | X | – | – | – | 2 | 0 | 4 | – | 1 | 0 | 9 |
| 4. 70¢ | – | X | X | X | – | 10 | 0 | 5 | – | X | – | – | – | 2 | 0 | 4 | – | 2 | 0 | 4 |
| 5. 70¢ | – | X | X | X | – | 1 | 6 | 5 | – | – | X | – | – | 1 | 4 | 1 | – | 1 | 3 | 3 |
| 6. 70¢ | – | X | X | X | – | 1 | 6 | 2 | – | – | X | – | – | 1 | 4 | 1 | – | 1 | 4 | 1 |
| 7. $1.55 | X | X | X | X | 5 | 0 | 0 | 40 | X | – | – | – | 1 | – | – | 11 | 1 | – | – | 11 |
| 8. $1.55 | X | X | X | X | 5 | 4 | 1 | 40 | – | X | – | – | 1 | 2 | 0 | 1 | 1 | 1 | 1 | 4 |

Fig. 5

COIN PAYOUT METHOD AND CONTROL MEANS

FIELD OF THE INVENTION

The present invention relates to providing change to customers from vending machines and, more particularly, to extending the period of time which a vending machine is capable of providing correct change to such customers without requiring an operator to manually replenish the coin tubes.

BACKGROUND OF THE INVENTION

Vending machines often include change payout apparatus for paying out change to a customer in the event of an excess deposit, i.e., a deposit which exceeds the vend price. Examples of such vending machines are set forth in U.S. Pat. Nos. 3,754,629, 3,820,642, and 3,841,456, all of which are assigned to the present assignee.

In vending machines capable of paying out change in the event of an excessive deposit, a plurality of a coin tubes generally are utilized for storing coins. Each coin tube is designated to store coins of one denomination, e.g., quarter, nickel, or dime. Initially, an operator fills each coin tube with the designated denomination. In operation, when a customer makes an excess deposit, the amount of change due is determined and paid out from the coin tubes.

To avoid having to frequently replenish the coin tubes, a deposited coin is supplemented to coins stored in a coin tube if the coin tube is not full. If the coin tubes are full, a deposited coin is routed to a cash box. For example, if the quarter tube is not full, deposited quarters will be routed to the quarter tube. Examples of vending machines including coin tubes and routing mechanisms are set forth in U.S. Pat. Nos. 3,963,035 , 4,587,984, and 5,184,708, all of which are assigned to the present assignee.

Vending machines also typically include structure to sense the number of coins in each coin tube and to control the payout of change using the highest possible denominations of coins. Lower denomination coins are used if the quantity of coins in the higher denomination coin tubes has fallen below a predetermined level. Paying out change using the highest possible denominations of coins generally is known as a "least coin payout".

Once the quantity of coins in a coin tube falls to a predetermined level, and if payout of proper change is not possible without a coin from such tube, the vending machine requires an exact deposit equal to the vend price to make a sale. A customer, fully aware that proper change is not possible, could still make an excess deposit and a vend operation would be performed. Under such circumstances, however, the customer will receive a payout less than the difference between the vend price and the amount deposited. Examples of such coin level detection and payout control are set forth in U.S. Pat. Nos. 3,963,035 and 4,587,984, which are mentioned above, and U.S. Pat. No. 4,763,769, assigned to the assignee of the present invention.

Paying out change using the highest denomination of coins facilitates maintaining a better "mix" of coins stored in the coin tubes and operating a vending machine for longer periods of time without requiring customers to deposit exact change. While devices which implement the least coin payout are useful, these devices do not anticipate whether the quantity of coins for a particular coin type is likely to fall below the predetermined level required to continue payout of such coin type. Rather, these devices simply payout coins from each available tube using the highest possible denomination of coins. Exact deposit is required once a particular coin type required for payout is not available and until the coin tubes for such coin type are replenished.

Since many customers often do not have coins readily available to make such an exact deposit, sales usually are lost when a vending machine requires exact deposit. Further, having an operator frequently replenish the coin tubes for each vending machine generally is expensive, particularly when a number of vending machines are located in a large geographic area.

Accordingly, it is desirable and advantageous to provide a vending machine capable of paying out change for long periods of time without requiring an operator to manually replenish the coin tubes. It is also desirable and advantageous to provide a vending machine which generates data indicating that the quantity of coins for a particular coin type may be more likely than the quantity of coins of other coin types to fall to a predetermined minimum level and, based on such data, automatically attempts to save coins of such coin type without quickly depleting other coin types.

An object of the present invention is to provide a vending machine for saving, i.e., not paying out, a coin of a particular coin type which is most likely, as compared to other coin types, to first reach a condition in which further payout of such coin type is not possible.

Another object of the present invention is to provide a vending machine which operates so as to maintain a better mix of coins stored in the coin tubes.

Yet another object of the present invention is to provide a vending machine capable of paying out change for long periods of time without requiring an operator to manually replenish the coin tubes.

Still yet another object of the present invention is to provide a vending machine which provides an accurate payout to a customer and operates to facilitate preventing the quantity of coins for each coin type from falling below a predetermined level.

SUMMARY OF THE INVENTION

These and other objects of the invention are obtained in an assembly constructed in accordance with the present invention. In carrying the various objects of the present invention in one form thereof, a microprocessor-based vending machine is provided, such as the machine described in U.S. Pat. No. 4,763,769, which is assigned to the present assignee. The machine includes processing means and a plurality of coin tubes.

Coin tube status means, which may include counters, monitor the deposit and payout of coins from each coin tube. In one embodiment, for example, one counter is associated with each coin tube. The counter associated with a particular coin tube is incremented each time a coin is deposited in the tube and the counter is decremented each time a coin is paid out from the tube. The instantaneous value of the counter is equal to "coins in" minus "coins out" for the associated tube. Such value is sometimes referred to herein as a "coin count". The coin type having the lowest coin count, for example, could be selected as the coin type to save.

After a deposit is made in the vending machine, the amount of change due, if any, is determined by the processing means. If change is due, i.e., a payout is to be made, the processing means sets the total amount of the payout equal to $CHANGE_{TOT}$.

The processing means then determines, such as by checking status registers, whether a coin is to be saved. An operator, for example, could select operation of the machine in a save mode or such selection could be made at a factory. In addition, even if the operator enables the save mode, conditions can be contemplated under which coin saving may not be necessary. For example, if sufficient quantities of each coin type are stored in the coin tubes, coin saving may be unnecessary. When such conditions are present, no actual coin saving will occur until the processing means determines that coin saving is necessary.

In addition to determining the amount of payout and whether to attempt to save one coin, the processing means obtains inputs regarding the quantity of coins for each coin type. Particularly, the processing means obtains inputs indicating whether the quantity of coins for any particular coin type has fallen below a predetermined level. If the quantity of coins for any type has fallen below such level, then such coin type is removed from possible selection for analysis in connection with the payout.

At this point in processing, therefore, the processing means has determined the amount of change to be paid out, whether one coin is to be saved in making the payout, and which coin types are available for making the payout. The next step is to determine the quantity of coins of each coin type to be used in making the payout.

In determining the quantity of coins of each coin type to be used in the payout, the processing means initiates creation, in system memory, of a payout array composed of a quantity ($N_{Tx}$) of coins to be paid out from each coin tube. The array is created by sequentially determining how many coins of each available coin type should be designated for payout. Two modes of coin saving operations are described hereinafter in detail with respect to creating a payout array. A first mode is referred to herein as the "coin type saving mode" and a second mode is referred to herein as the "coin tube saving mode". The term "payout array", as used herein, refers only to a designation of coins to be paid out and is not limited to any particular structure or form nor any specific manner of generating such designation.

With respect to the coin type saving mode, the processing means identifies a type of coin, e.g., quarter, dime or nickel, to be saved. In the coin tube saving mode, the processing means selects a coin tube from which coins are to be saved. Of course, if the number of coin tubes equals the number of coin types, the coin type saving mode would generate an identical payout array as the coin tube saving mode. In a vending machine having a plurality of tubes designated for storing a same coin type, e.g., two nickel coin tubes, the coin tube saving mode may provide a different payout array than the coin type saving mode. For example, a first nickel tube may have a sufficient quantity of coins while the quantity of coins in a second nickel tube may be low. Saving nickels from the first nickel tube may be unnecessary yet nickels may need to be saved from the second nickel tube. The coin tube saving mode would generate a payout array that saves nickels from the second tube.

In the coin type saving mode of operation, and starting with the highest ranked coin type that can be used for payout of the remaining amount of the payout ($CHANGE_{REM}$), the processing means determines the maximum number of coins ($M_{Tx}$) of such type that could be used for payout. Initially, $CHANGE_{REM}$ is set to equal $CHANGE_{TOT}$. The value of the amount of change determined ($CHANGE_{DET}$) is set to equal the value of the coins of the subject coin type that could be used for payout (i.e., $M_{TX}$×(coin value)).

If the coin type presently being analyzed is not the coin type to be saved, then the quantity $N_{Tx}$ is set to equal $M_{Tx}$. If the coin type to be saved is the coin type presently being analyzed, however, then one coin of such type will be removed from the maximum count $M_{Tx}$ and the value of $CHANGE_{DET}$ is updated. That is, for the subject coin type, the quantity $N_{Tx}$ is set to equal ($M_{Tx}$−1) and the value of one such coin is subtracted from $CHANGE_{DET}$.

The value of the remaining change ($CHANGE_{REM}$) is then set to equal ($CHANGE_{REM}$−$CHANGE_{DET}$). If $CHANGE_{REM}$ is not equal to zero, processing proceeds to the next available highest ranked coin type. If, at any point in processing, $CHANGE_{REM}$ is equal to zero, then the quantities $N_{Tx}$ of coins determined for payout for each coin type are paid out. However, if after processing each available coin type, $CHANGE_{REM}$ is not equal to zero, then alternate payout arrays can be generated, such as a least coin payout array, and payout can be made using such alternate array.

As an example, consider a vending machine having quarter, dime and nickel coin types. The coin count for quarters is −5, the coin count for dimes is +2, and the coin count for nickels is −2. All coin types are available for payout. Since the coin count for quarters is the lowest count, a quarter is selected as the coin type to save.

If the total amount of change due a customer is determined to be equal to fifty five cents, the processing means sets $CHANGE_{TOT}$ equal to fifty five cents. The processing means then initiates operations on the quarter coin type since such type is the highest ranked coin type that can be used for payout. The processing means designates two quarters for payout by setting $M_{Tx}$ for the quarter coin type equal to two. $CHANGE_{DET}$ is then set to equal fifty cents.

Since the quarter coin type is the designated coin type to save, operations would continue with the processing means removing one quarter from the designated number of quarters for payout. That is, $N_{Tx}$ is set to equal ($M_{Tx}$−1). $CHANGE_{DET}$ is then set to equal fifty cents minus twenty five cents, or twenty five cents. The processing means then updates $CHANGE_{REM}$ to equal ($CHANGE_{REM}$ −$CHANGE_{DET}$), or in this case, thirty cents.

Processing then proceeds to the dime coin type. Upon completion of the above described operations on the dime coin type, the quantity $N_{Tx}$ of coins for the dime coin type would be set to three and $CHANGE_{DET}$ would equal thirty cents. After subtracting $CHANGE_{DET}$ from $CHANGE_{REM}$, $CHANGE_{REM}$ would equal zero.

A payout therefore would be made using one quarter and three dimes since $N_{TX}$ for the quarter type equals one and $N_{Tx}$ for the dime type equals three. If a least coin approach were utilized to make the payout of fifty five cents, the payout would be made using two quarters and one nickel. The present payout, therefore, resulted in saving one quarter as compared to the least coin payout.

By saving, when possible, one coin of a coin type having the lowest coin count, the vending machine saves a coin of the coin type which is most likely, as compared to other coin types in the machine, to first reach a condition in which further payout of such coin type is not possible. By saving only one coin of such coin type, other coin types are not quickly depleted. Such operation facilitates maintaining a better mix of coins stored in the coin tubes and paying out change for long periods of time without requiring an operator to manually replenish the coin tubes.

BRIEF DESCRIPTION OF THE DRAWINGS

FIG. 5 is a table illustrating various payouts for three and four coin tube vending machines.

DETAILED DESCRIPTION OF THE DRAWINGS

Figure 1:
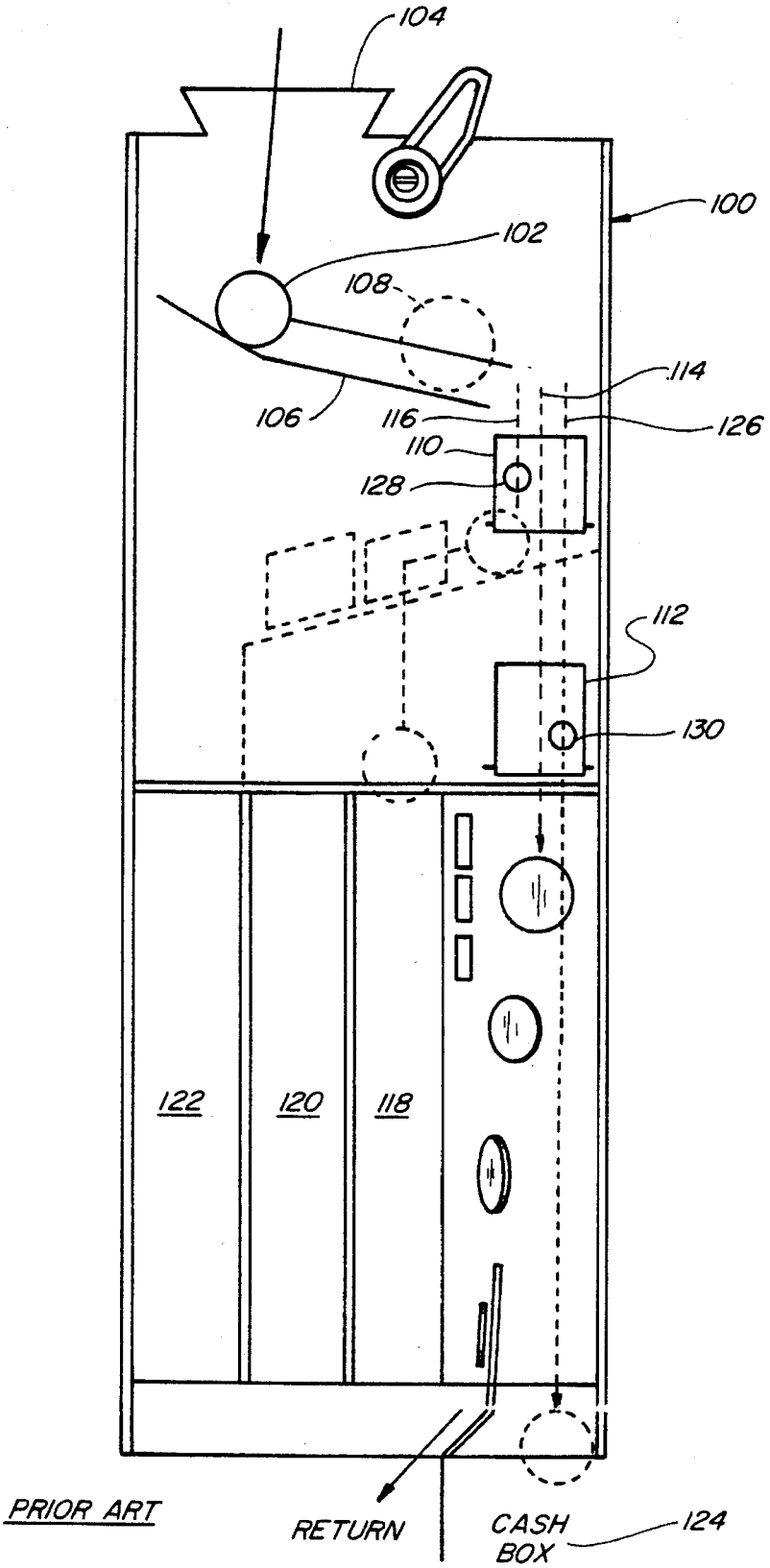
FIG. 1 is a diagrammatic depiction of a typical coin changer unit depicting in simplified formed various possible coin paths in and/or through such unit.

A coin changer unit 100 of the type typically employed in many existing vending systems is illustrated in FIG. 1. Coins, such as coin 102, may be deposited at coin inlet 104, and they thereafter move along a coin path 106, which path may include means of various types for mechanically sizing coins and separating certain kinds of slugs from among the coins deposited, to pass by and/or interact with a coin analysis or sensing means 108 that is operable to produce coin analysis data pertinent to such coin. Numerous types of coin analysis means and coin sensing means are known to those skilled in the art, any number of which means might be equally and advantageously used in vending systems constructed to include the coin payout control means of the present invention. Typical of some of such known coin analysis means and sensing means are constructions disclosed in U.S. Pat. Nos. 4,763,769 and 5,092,816, both of which are assigned to the present assignee and hereby incorporated herein by reference.

Depending upon whether either of the controllably operable diverters or gates 110 or 112 are operated, the coin may thereafter be caused to follow one of several different possible paths. If neither gates 110 or 112 are operated, the coin will follow path 114 to be returned to the customer. If gate 110 is operated, the coin will follow path 116 and, depending upon its denomination, will be directed into dime coin tube 118, nickel coin tube 120, quarter coin tube 122, or, if the appropriate coin tube is filled, will be caused to fall to the front or rear of the coin tubes or otherwise be directed into a coin collection or cash box 124. If gate 112 is operated instead of gate 110, e.g., as in the case of a deposit of a validated and accepted dollar coin, the coin will follow path 126 and be directed into cash box 124. Sensing means, such as sensing means 128 and sensing means 130, may be positioned to detect movement of the deposited coin past or through an appropriate gate or along an appropriate path and to produce sensor signals indicative of such coin detection.

Figure 2:
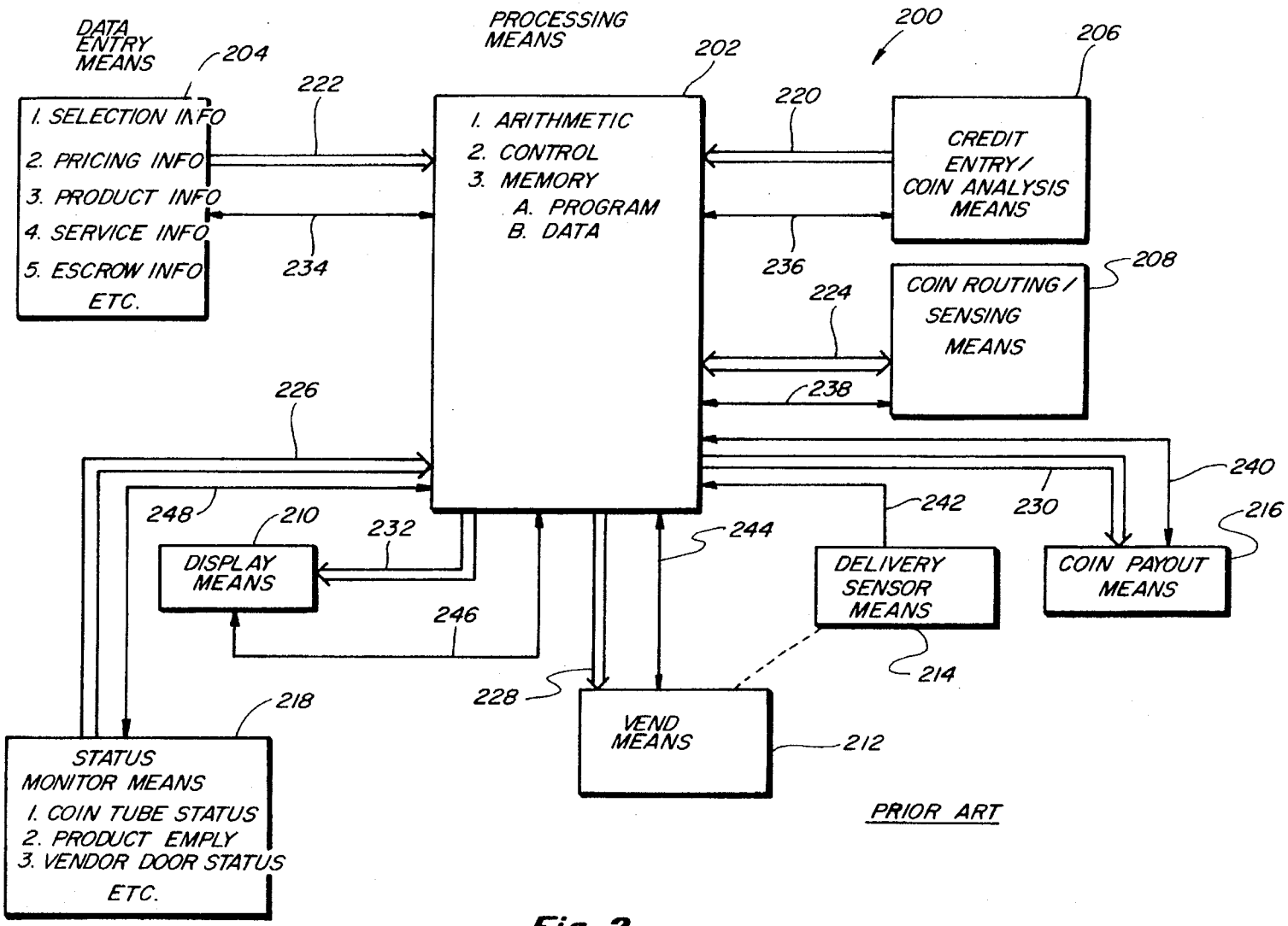
FIG. 2 is a block diagram of a vending system embodiment including a programmed microprocessor.

FIG. 2 illustrates, in block form, a microprocessor controlled vending system 200 that includes a processing means 202, data entry means 204, credit entry/coin analysis means 206, coin routing/sensing means 208, display means 210, vend means 212, delivery sensor means 214, coin payout means 216, and status monitor means 218. Processing means 202 includes memory means as well as arithmetic and control means typical of a microprocessor controlled vending system.

In system 200, coin analysis data may be supplied from the credit entry/coin analysis means 206 to the processing means 202 by means of a data path 220. Data information of various types, including selection information, pricing information, product information, and service information, may be provided from data entry means 204 to processing means 202 by means of a data path 222. Coin routing/sensing data may be provided from coin routing/sensing means 208 to processing means 202 by means of a data path 224. Status data, including coin tube status information, product empty information, and vendor status information, may be provided from status monitor means 218 to processing means 202 by memos of a data path 226. Data for vend purposes may be provided from processing means 202 to vend means 212 by way of data path 228. Coin payout data may be provided from processing means 202 to coin payout means 216 by way of data path 230, and information for display may be communicated from processing means 202 to display means 210 by means of data path 232. Various control and status signals may be intercommunicated among the components of the microprocessor controlled vending system means of signal paths 234, 236, 238, 240, 242, 244, 246, and 248.

System 200 could be coupled to changer unit 100 (FIG. 1 ), with certain components in unit 100 forming part of the means illustrated in block form in FIG. 2. For example, credit entry/coin analysis means 206 could be formed, in part, by means 108. Coin routing/sensing means 208 could be formed, in part, by gates 110 and 112. The coin tube status monitor of monitor means 218 could be coupled to coin tubes 118, 120 and 122 and include counters and coin level detectors spaced along each coin tube.

Coin changer unit 100 (FIG. 1 ) and microprocessor controlled vending system 200 (FIG. 2) illustrate only one of many changer units and vending systems which could be utilized with the present invention to realize the advantages thereof. It will be readily apparent that many other changer units and vending systems might be equally well utilized in connection with the present invention.

Figure 3:
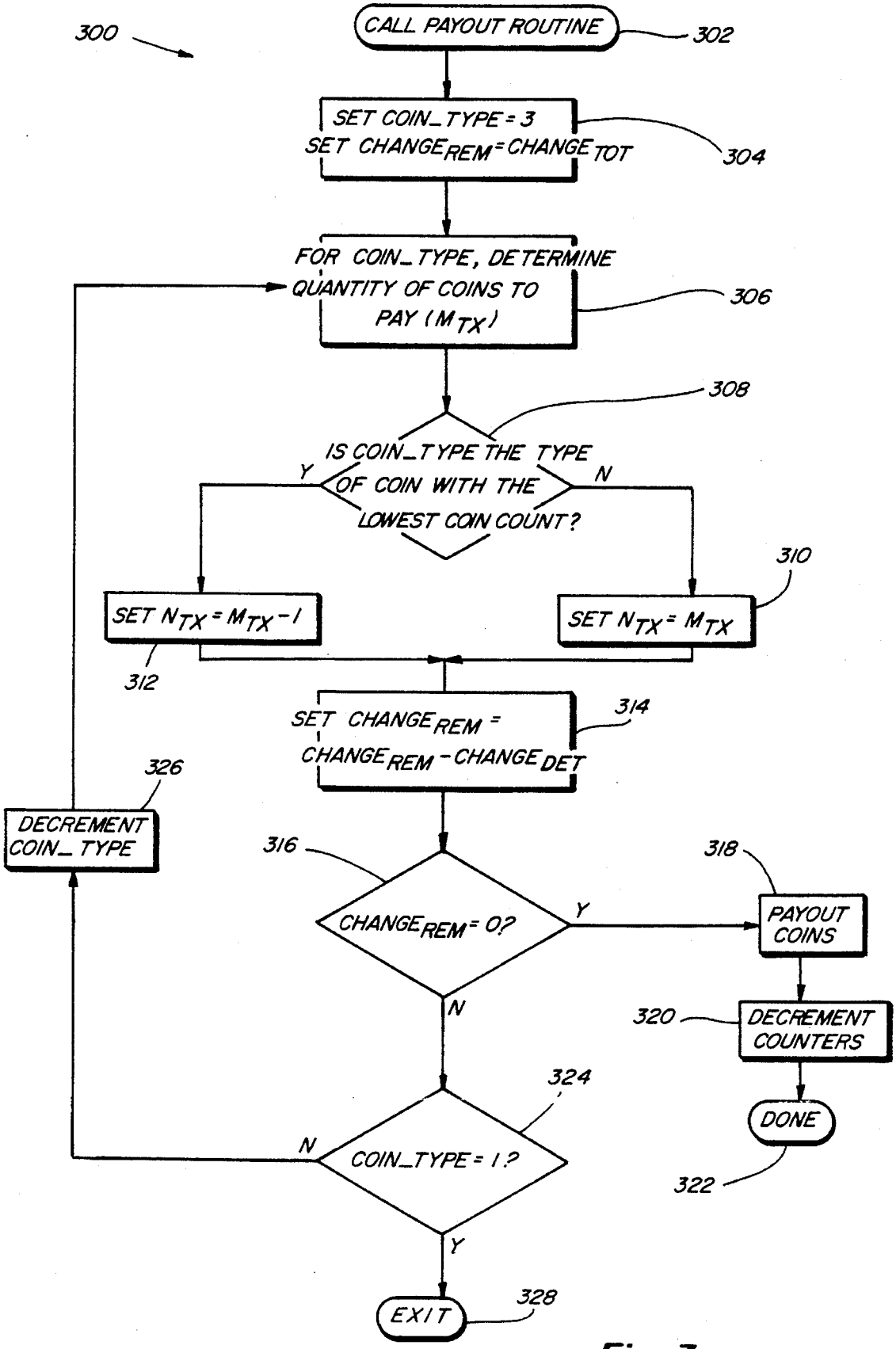
FIG. 3 is a flow chart illustrating a first sequence of process steps, in accordance with one form of the present invention, that may be utilized with the vending machine system illustrated in FIG. 2.

FIG. 3 is a flow chart 300 for a sequence of process steps, in accordance with one form of the present invention, that may be utilized with the vending machine system illustrated in FIG. 2. The process steps would, for example, be executed by processing means 202 controlled by a resident control program, often firmware. Many variations are possible, and many routines could be used in combination with such steps.

Prior to executing the process steps illustrated in flow chart 300, a coin count is generated for each coin type or coin tube, coin type or tube availability is determined, and the processing means determines whether to execute a coin save operation. In addition, the total amount of change ($CHANGE_{TOT}$) to be paid out is determined by the processing means.

A coin count for each coin type is generated by counters which form part of the coin tube status monitor means. In one embodiment, for example, one counter is associated with each coin tube. As described hereinabove, the associated counter is incremented each time a coin is deposited in the associated tube and the counter is decremented each time a coin is paid out from the tube. The value of the counter is equal to "coins in" minus "coins out" for the associated tube.

If a plurality of coin tubes are utilized for storing a same coin type, e.g., two nickel coin tubes, then the values of the counters associated with such coin tubes would be added together to provide a count for such coin type. For example, if there are two nickel tubes with one nickel tube having a count of twenty and the other nickel tube having a count of negative five, the counts would be added together to provide a nickel coin count of fifteen.

Alternatively, rather than using a coin count, a coin ratio could be generated for each coin type. Particularly, if a coin ratio is to be determined, the coin tube status monitoring means would include two counters associated with each coin tube. With respect to each coin tube, a first counter is incremented each time a coin is deposited in the tube and a second counter is incremented each time a coin is paid out from the tube. The processing means determines a coin ratio by dividing the value of the first counter by the value of the second counter, i.e., coins in/coins out. As with the coin count, if a plurality of tubes are used to store a same coin type, the coin ratios would be combined to provide a total coin ratio.

Many other variations of generating a value, or data, indicating whether a particular coin type is being depleted more quickly relative to other coin types are contemplated and possible. The above described coin counts and coin ratios are examples, and other values or data could be utilized.

With respect to determining coin availability, the processing means obtains inputs regarding the quantity of coins for each coin type. Particularly, processing means 202 obtains inputs from status monitor means 218 indicating whether the quantity of coins for any particular type has fallen below a predetermined level. If the quantity of coins of any type has fallen below such level, then such coin types are removed from possible selection for analysis in connection with the payout. Processing means 202 may, for example, obtain the necessary information from coin level detectors of monitor means 218 associated with each coin tube.

With respect to whether the coin save mode is operable in the subject machine, an operator, for example, could select operation of the machine in a coin save mode or such selection could be made at a factory by setting a switch or setting a flag in the memory of processing means 202. In addition, even if the operator enables the coin save mode, if processing means 202 determines that sufficient quantities of each coin type are stored in the coin tubes, coin saving may be unnecessary. Such a determination could be made by processing means 202, for example, by checking the status of level detectors associated with each coin tube. When a sufficient quantity of coins for each coin type are available, the coin save operation will not be executed and no actual coin saving will occur until the processing means determines that coin saving is necessary. If, however, the quantity of any coin type is below the predetermined level, then the coin save operation will be executed. By checking status registers and coin levels, the processing means initially determines whether to attempt to save a coin in making a payout.

Processing means 202 also determines the amount of change to be paid out. Particularly, by subtracting the amount deposited by a customer from the vend price of the item selected by the customer, the total change ($CHANGE_{TOT}$) to be paid out is determined.

At this point in processing, therefore, coin counts, $CHANGE_{TOT}$, and coin availability have been determined. In addition, the processing means has determined whether a coin is to be saved in making the payout. Also, each coin type is assigned a value, e.g., quarters=3, dimes=2, and nickels=1.

Referring now particularly to FIG. 3, the process steps set forth in flow chart 300 would be executed if the processing means determines that a coin should be saved utilizing the "coin type saving mode" in making the payout. Specifically, processing means 202 calls the payout routine at step 302. At step 304, processing means 202 sets the value of the Coin_Type register to equal 3 and $CHANGE_{REM}$ to equal $CHANGE_{TOT}$. The value of 3 for Coin_Type corresponds to the number of coin types in the machine as explained above. Coin_Type would be set to other values if more or less than three coin types are utilized. For example, if four coin types are utilized (e.g., dollar, quarter, dimes and nickels), Coin_Type would be set to equal 4. If two coin types are utilized (e.g., dimes and nickels), Coin_Type would be set to equal 2. In flow chart 300, the machine under processing control contains three coin types, i.e., quarters, dimes and nickels.

Processing proceeds to step 306 where for the subject Coin_Type, processing means 202 determines the quantity ($M_{Tx}$) of such coins which can be paid out. For example, if $CHANGE_{TOT}$ equals sixty five cents, and for Coin_Type=3 (i.e., quarters), $M_{Tx}$ would be set to equal 2, or fifty cents. Then, at step 308, processing means 202 checks whether the subject Coin_Type is the coin type having the lowest coin count. For example, if the quarter coin count is 30, the dime coin count is 15, and the nickel coin count is 45, processing means 202 would determine that Coin_Type 3 does not have the lowest coin count. Processing would proceed to step 310 where the quantity of coins $N_{TX}$ for Coin_Type 3 selected for inclusion in the payout is set to equal $M_{Tx}$, or 2.

If, however, the subject Coin_Type were the type of coin with the lowest coin count, then $N_{Tx}$ would be set to equal $M_{Tx}-1$ at step 312. That is, the maximum number of coins for the subject Coin_Type that could be used in making the payout is reduced by one. As a result, one coin of the Coin_Type having the lowest coin count is saved.

Processing proceeds to step 314 where processing means 202 sets the value of $CHANGE_{REM}$ equal to ($CHANGE_{REM}-CHANGE_{DET}$) where $CHANGE_{DET}$ equals ($N_{Tx}\times$ (value of Coin_Type)). Continuing with the example above, for Coin_Type 3 (quarters), $N_{TX}$ was determined to equal 2. Therefore, $CHANGE_{DET}$ equals (2×25 cents), or fifty cents. $CHANGE_{REM}$ initially was equal to sixty five cents. Subsequent to step 314, $CHANGE_{REM}$ would equal sixty five cents minus fifty cents, or fifteen cents.

At step 316, the value of $CHANGE_{REM}$ is checked to determine whether it equals zero. If $CHANGE_{REM}$ is equal to zero, then the quantity $N_{Tx}$ of coins determined for each coin type is paid out at step 318. Subsequent to the payout, the counters associated with each coin tube are decremented at step 320 and operations are finished as indicated at step 322.

If $CHANGE_{REM}$ is not equal to zero, then processing means 202 checks whether the value of the subject Coin_Type is equal to 1. If the value of the subject Coin_Type is not equal to 1, then the value of Coin_Type is decremented at step 326 and operations continue at step 306. If, however, the value of Coin_Type is determined to equal 1, this means that all the Coin_Types have been analyzed and payout using the present routine is not possible. Therefore, an exit from the routine is provided at step 328. An alternative payout routine, such as a least coin payout routine, could subsequently be called by processing means 202 in determining the payout.

In the manner set forth above, one coin of a particular coin type is saved. The coin type selected for saving is determined, for example, by selecting the coin type having the lowest coin count. Of course, many other variations are possible and contemplated. For example, a coin type could be saved only if such coin type has the lowest coin count and if the next available coin type has a value no less than five times the value of the coin type to be saved. As a specific example of such variation, if a dollar coin type is to be saved but the next available coin type is a dime, rather than paying out ten dime coins in place of one dollar coin, which could have the effect of quickly depleting the dime coins, the save operation could be disabled or another coin type could be selected for saving. While it has been found advantageous to employ a factor of five (5) for use with U.S. coin sets, it should be understood that other factors, or no factor, could be equally as well employed, particularly with other coin sets. As another variation example, if two coin types have the same coin count, then processing means 202 could be programmed to select the coin type having the lowest value as the coin type to be saved.

Figure 4A:
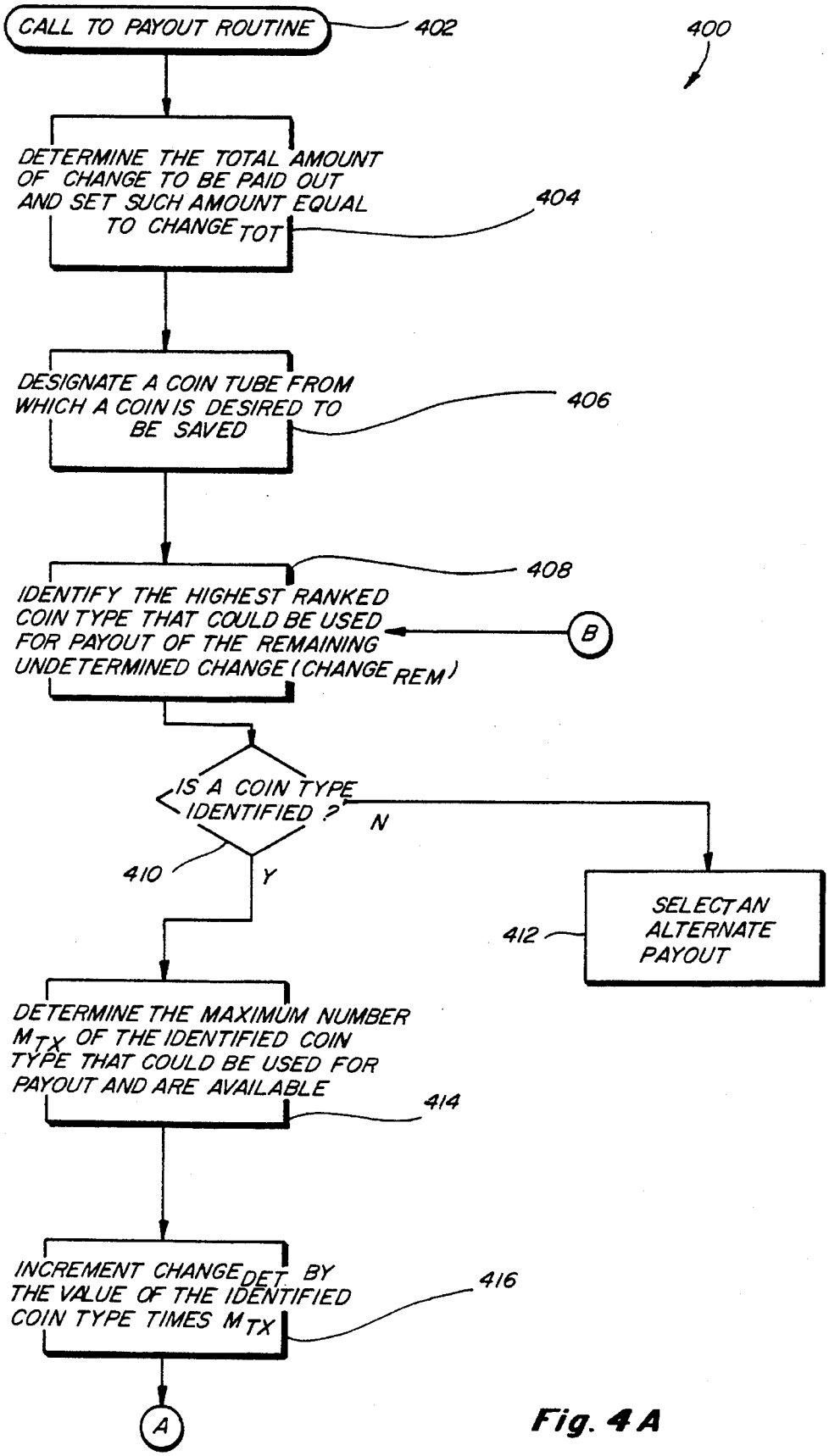
FIGS. 4A and 4B are flow charts illustrating a second sequence of process steps, in accordance with another form of the present invention, that may be utilized with the vending system illustrated in FIG. 2.
Figure 4B:
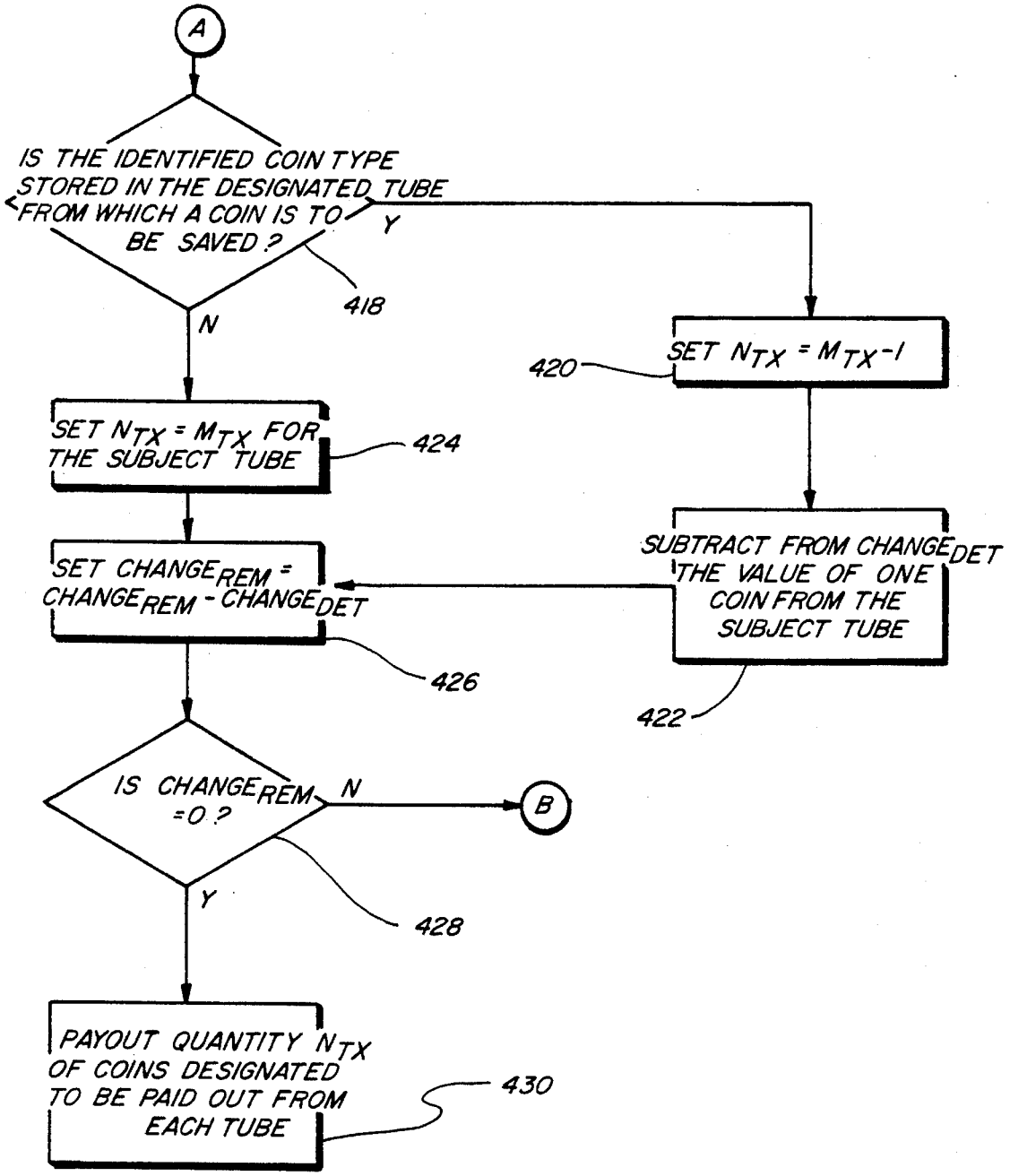

Referring now to flow chart 400 illustrated in FIG. 4A and 4B, steps which are executed in saving one coin from a designated coin tube are illustrated, i.e., the coin tube saving mode. As with the coin type saving mode, coin counts and coin availability have been determined. The coin count, however, is a count of"coins in" minus "coins out" by tube rather than coin type. Also, coin availability is determined by coin tube rather than coin type.

With specific reference to flow chart 400, after a deposit is made in the vending machine, processing means 202 operates to call the present payout routine at step 402. Processing means 202 then determines the amount of change due, if any, and the amount of change due, i.e., the payout to be made, is set to equal $CHANGE_{TOT}$ at step 404. Processing means 202 then designates a coin tube from which a coin is desired to be saved at step 406. Such designation could be made, for example, by selecting a coin tube having the lowest coin count or coin ratio.

Processing means 202 then initiates creation, in system memory, of a payout array composed of the quantity ($N_{Tx}$) of coins to be paid out from each coin tube. The array is created, in this embodiment, by first identifying the highest ranked coin type that could be used for payout of the remaining undetermined change ($CHANGE_{REM}$) as indicated at step 408. In the first iteration, $CHANGE_{REM}$ will equal $CHANGE_{TOT}$. If a coin type is not identified prior to step 410, then an alternate payout will be selected as indicated at step 412.

If a coin type is identified prior to step 410, then processing means 202 is instructed at step 414 to determine the maximum number $M_{Tx}$ of the identified coin type that could be used for payout and are available. Once such maximum number $M_{Tx}$ of coins are identified, processing means 202 increments the value of $CHANGE_{DET}$ by the value of the identified coin type time $M_{Tx}$ as indicated at step 416.

Operations continue as indicated by a connector "A". If the identified coin type is the stored in the coin tube designated as the tube from which one coin is to be saved, as determined at step 418, then processing means 202 sets $N_{Tx}$ equal to ($M_{Tx}$–1) at step 420 and the value of the one coin of the identified coin type is subtracted from the value of $CHANGE_{DET}$.

If the identified coin type is not stored in the designated coin tube, then $N_{Tx}$ is set to equal $M_{Tx}$ for the subject tube at step 424. Processing continues at step 426 subsequent to execution of step 422 or 424 by processing means 202 setting $CHANGE_{REM}$ equal ($CHANGE_{REM}$–$CHANGE_{DET}$) at step 426. If $CHANGE_{REM}$ is equal to zero as determined at step 428, then the quantity $N_{Tx}$ of coins designated to be paid out from each tube is paid out under control of processing means 202. If $CHANGE_{REM}$ is not equal to zero, then processing continues, as indicated by a connector "B", to identify the highest ranked coin type that could be used for payout of $CHANGE_{REM}$ as set forth in step 408. Processing continues in this manner until a payout is made at step 430 or it is determined that an alternate payout must be selected as indicated at step 412.

Utilizing the steps illustrated in flow chart 400, one coin from a designated tube is saved in making a payout. As with the coin type saving illustrated by way of example in flow chart 300 (FIG. 3), many variations of the coin tube saving operation are possible and contemplated.

The present invention, as is evident from the above description, facilitates enabling a vending machine to pay out change for long periods of time without requiring an operator to manually replenish the coin tubes. This result is provided by generating data (e.g., a coin count or coin ratio) indicating that the quantity of coins in a particular coin tube or of a particular type may be more likely than the quantity of coins in other coin tubes or of other types to fall to a predetermined minimum level and using such data to automatically attempt to save coins without quickly depleting other coin tubes or types. Such payout control also facilitates maintaining a better mix of coins stored in the coin tubes which enables providing accurate payouts to customers for longer periods of time.

To provide further illustration of the present invention in one form thereof, a table illustrating various payouts is set forth in FIG. 5. With respect to the vertical columns, the "Payout Amount" column refers to the amount to be paid out from the vending machine. The "Coin Types" (d-dollar, q-quarter, d-dimes, n-nickel) column refers to the types of coins contained in the vending machine. The "Coin Avail." column refers to the number of coins available in each tube type. The "Coin_To_Save" column identifies the type of coin to be saved in making the payout. The "Least Coin Payout Array" column identifies the quantity of coins for each coin type that would be paid out using the least coin approach. The "Save Coin Payout Array" column identifies the quantity of coins for each coin type that would be paid out when attempting to save a coin type designated in the Coin_To_Save column.

Referring to Payout No. 1, the amount to be paid out is seventy cents. The vending machine has quarter, dime and nickel coin types. All of the coin types are available, e.g., the coin tubes are full (F), and the Coin_To_Save is a quarter. The least coin payout array contains two quarters and two dimes for payment. In the Save Coin Payout Array, however, and since quarters are to be saved, only one quarter is designated for payout Four dimes and one nickel are designated to make up the balance of the amount due.

With respect to Payout No. 2, rather than the coin tubes being full for each coin type, the quarter coin tube has ten quarters and the dime coin tube has three dimes. Such a limitation on the quantity of coins makes no difference in connection with creating the least coin payout array as compared to when all coin tubes are full. However, with respect to the Save Coin Payout Array, since only three dimes are available, only three dimes can be used. Therefore, the remaining balance is made up by using two additional nickels as compared to Payout No. 1. Such operation illustrates that even if the required quantity of coins for a particular coin type are not available, if payment can be made using coins of other coin types, such payment will be made. Therefore, one coin of the designated coin type is saved in the Save Coin Payout Array.

Payout No. 3 has the same parameters as Payout No. 2 except that there are no dimes available. Since a quarter is not greater than five times more valuable than a nickel, the save operation is not disabled and the Save Coin Payout Array is created saving one quarter.

Payout No. 4 has the same parameters as Payout No. 3 except that the quantity of nickels available for payout is limited to five. Payout is not possible by saving one quarter, and therefore, the Save Coin Payout Array contains two quarters, as does the Least Coin Payout Array.

In Payout No. 5, there are one quarter, six dimes, and five nickels available for payout. The dime coin type is designated as the coin type to save. The Least Coin Payout Array contains one quarter, four dimes and one nickel. Such a payout leaves only two dimes for a next payout. By saving one dime, however, as illustrated in the Save Coin Payout Array, three dimes are available for a next payout since only three dimes are contained in the Save Coin Payout Array.

The same parameters are present for Payout No. 6 as in Payout No. 5 except that in Payout No. 6, there are only two nickels available for payout. Since payout is not possible by saving one dime with only two nickels available for payout, and rather than not make an accurate payout, one dime is not saved. Therefore, the Least Coin Payout Array is identical to the Save Coin Payout Array.

With respect to Payout No. 7, one dollar and fifty five cents is the Payout Amount. The vending machine contains dollar, quarter, dime and nickel coin types. Five dollar coins and forty nickel coins are available. No quarters and no dimes are available for payout. The Coin_To_Save is set to the dollar coin. The Least Coin Payout Array contains one dollar coin and eleven nickel coins. With respect to the Save Coin Payout Array, although there are sufficient nickels to make the entire payout in nickels, since one dollar is more than five times the value of one nickel, and since no quarters are available for payout, the dollar coin will not be saved. Therefore, the Save Coin Payout Array is identical to the Least Coin Payout Array.

In Payout No. 8, the same Payout Amount and Coin Types are set as in Payout No. 7. However, in Payout No. 8, four quarters and one dime also are available. Rather than saving a dollar coin type as in Payout No. 7, a quarter coin type is the Coin _To_Save in Payout No. 8. The Least Coin Payout Array contains one dollar, two quarters and one nickel. The Save Coin Payout Array, however, saves one coin for the quarter coin type. Therefore, the Save Coin Payout Array contains only one quarter.

The payouts set forth in the table of FIG. 5 illustrate various payouts and provide a comparison between the payout arrays created using the least coin payout approach and the save coin payout approach.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. The various described processing steps, for example, could be modified in many ways and still achieve the objective of saving, when possible, one coin of a selected coin type or from a selected coin tube. Such saving, as set forth above, facilitates maintaining a better mix of coins and paying out change for long periods of time without requiring an operator to manually replenish the coin tubes. In addition, by saving only one coin, other coin types and tubes are not quickly depleted. Of course, in certain circumstances, it is contemplated that more than one coin could be saved and more than one coin type could be saved in making a payout. Accordingly, the spirit and scope of the invention are to be limited only by the terms of appended claims.

What is claimed is:

1. A method of saving specified coin types during a change payout operation of a vending system, comprising the steps of:

(1) determining (a) the total amount of change payout ($CHANGE_{TOT}$) required, such total amount initially being the remaining undetermined change payout required ($CHANGE_{REM}$) when no determined change payback ($CHANGE_{DET}$) has been established, and (b) the specific coin type (TX where X corresponds to a particular coin type) desired to be saved, (2) identifying the remaining undetermined change payout required ($CHANGE_{REM}=CHANGE_{TOT}-CHANGE_{DET}$) and the highest ranked coin type, not yet considered, that could be used for change payback;

(3) determining the maximum number ($M_{Tx}$) of such identified highest ranked coin type that would be required for such payout of $CHANGE_{DET}$ and which are available for payout;

(4) determining whether such identified highest ranked coin type is the specific coin type desired to be saved and, based thereupon, establishing the number of such identified coin type to be paid back as $N_{Tx}=M_{Tx}$ if such highest ranked coin type is not the specific coin type desired to be saved or as $N_{Tx}=M_{Tx}-1$ if such highest ranked coin type is the specific coin type desired to be saved, and calculating $CHANGE_{DET}$ to such point in time;

(5) effecting change payout of the established numbers $N_{Tx}$ of the identified coin type (TX) if there is no remaining undetermined change payback or either:

(a) proceeding to step (2) if the lowest ranked coin type has not been considered; or (b) effecting alternative change payout.

2. The method of claim 1 wherein step (1) includes the step of (1)

(c) determining whether the next lower ranked coin available for change payout has a value at least five times less than the value of the specific coin type desired to be saved and if so, disabling coin save before proceeding to step (2).

3. A method of saving specified coin types during a change payout operation of a vending system, comprising the steps of:

(1) determining (a) the total amount of change payout ($CHANGE_{TOT}$) required, such total amount initially being the remaining undetermined change payout required ($CHANGE_{REM}$) when no determined change payback ($CHANGE_{DET}$) has been established, and (b) whether coin save has been disabled and, if so, proceeding to step (2), otherwise proceeding to step (1)(c);

(c) the specific coin type (TX where X corresponds to a particular coin type) desired to be saved;

(2) identifying the remaining undetermined change payout required ($CHANGE_{REM}=CHANGE_{TOT}-CHANGE_{DET}$) and the highest ranked coin type, not yet considered, that could be used for change payback;

(3) determining the maximum number ($M_{Tx}$) of such identified highest ranked coin type that would be required for such payout of $CHANGE_{DET}$ and which are available for payout;

(4) determining whether such identified highest ranked coin type is the specific coin type desired to be saved and, based thereupon, establishing the number of such identified coin type to be paid bask as $N_{Tx}=M_{Tx}$ if such highest ranked coin type is not the specific coin type desired to be saved or as $N_{Tx}=M_{Tx}-1$ is such highest ranked coin type is the specific coin tube desired to be saved, and calculating $CHANGE_{DET}$ to such point in time;

(5) effecting change payout of the established numbers $N_{Tx}$ of the identified coin type (TX) if there is no remaining undetermined change payback or either:

(a) proceeding to step (2) if the lowest ranked coin type has not been considered; or (b) effecting alternative change payout.

4. The method of claim 3 wherein step (1) includes the step of (1)

(d) determining whether the next lower ranked coin available for change payout has a value at least five time less than the value of the specific coin type desired to be saved and, if so, disabling coin save before proceeding to step (2).

5. A device for controlling change payout in a vending machine having a plurality of coin tubes for storing coins, each coin tube having one coin denomination type stored therein, comprising processing means for processing data and controlling vend operations and coin tube status means for establishing and maintaining a running count of coins in the coin tubes as coins enter and leave the coin tubes, said processing means being programmed to both determine the amount of change desired to be paid out during a vend operation and whether a particular coin type is desired to be saved, said processing means further programmed to generate, based upon the total amount of change desired to be paid out and any particular coin type desired to be saved, a payout array in which the number of coins of the coin type desired to be saved has been reduced from the number that would otherwise be specified if that particular coin type were not desired to be saved and the number of coins of other coin types are correspondingly adjusted, wherein generating a payout array comprises the steps of:

(1) identifying the remaining undetermined change payout required;

(2) starting with a coin type not yet considered and having the highest ranked coin type, determining the maximum quantity of coins ($M_{Tx}$) of such coin type that could be used in making the change payout;

(3) determining whether such identified highest ranked coin type is the specific coin type designated to be saved and, based thereupon, establishing the number of such identified coin type to be paid out as $N_{Tx}=M_{Tx}$ if such highest ranked coin type is not the specific coin type desired to be saved or as $N_{Tx}=M_{Tx}-1$ if such highest ranked coin type is the specific coin type desired to be saved;

(4) calculating the determined change payback based on the determined values of $N_{Tx}$;

(5) effecting change payout of the established values of $N_{Tx}$ if there is no remaining undetermined change payback or either:

(a) proceeding to step (1) if the lowest ranked coin type has not been considered; or (b) effecting alternative change payout.

6. A method of saving a specified coin type during a change payout operation of a vending system, wherein a coin of the specified coin type is available for change, comprising the steps of (a) determining the particular coin type desired to be saved;

(b) adjusting the coin type payout determination to reduce the number of coins of the particular coin type desired to be saved from the number of coins of that particular coin type that would otherwise be specified for change payback;

(c) correspondingly adjusting the number of coins of other coin types to be utilized for change payout to compensate insofar as possible for the reduction in the number of coins of the particular coin type desired to be saved;

wherein steps (b) and (c) comprise the steps of:

(1) identifying the remaining undetermined change payout required;

(2) starting with a coin type not yet considered and having the highest ranked coin type, determining the maximum quantity of coins ($M_{Tx}$) of such coin type that could be used in making the change payout;

(3) determining whether such identified highest ranked coin type is the specific coin type designated to be saved and, based thereupon, establishing the number of such identified coin type to be paid out as $N_{Tx}=M_{Tx}$ if such highest ranked coin type is not the specific coin type desired to be saved or as $N_{Tx}=M_{Tx}-1$ is such highest ranked coin type is the specific coin type desired to be saved; p1 (4) calculating the determined change payback based on the determined values of $N_{Tx}$;

(5) effecting change payout of the established values of $N_{Tx}$ if there is no remaining undetermined change payback or either.

(a) proceeding to step (1) if the lowest ranked coin type has not been considered; or (b) effecting alternative change payout.

* * * * *

UNITED STATES PATENT AND TRADEMARK OFFICE

CERTIFICATE OF CORRECTION

PATENT NO. : 5,595,277

DATED : January 21, 1997

INVENTOR(S) : Ronald A. Hoormann and Douglas M. Pettty

It is certified that error appears in the above-indentified patent and that said Letters Patent is hereby corrected as shown below:

Column 6, Line 11, "memos" should be -- means -- .

Column 14, Line 43, "p1" should be a new paragraph.

Signed and Sealed this

Nineteenth Day of August, 1997

*Attest:*

*Attesting Officer*

Bruce Lehman

BRUCE LEHMAN

*Commissioner of Patents and Trademarks*